US006773134B2

(12) United States Patent
Harvey

(10) Patent No.: US 6,773,134 B2
(45) Date of Patent: Aug. 10, 2004

(54) ILLUMINATED ARTIFICIAL TREE

(76) Inventor: Neal Harvey, P.O. Box 84, Williston, NC (US) 28589

( * ) Notice: Subject to any disclaimer, the term of this patent is extended or adjusted under 35 U.S.C. 154(b) by 0 days.

(21) Appl. No.: 10/342,941

(22) Filed: Jan. 15, 2003

(65) Prior Publication Data

US 2004/0136181 A1 Jul. 15, 2004

(51) Int. Cl.[7] ..... F21S 6/00

(52) U.S. Cl. ..... 362/123; 362/252; 362/806; 428/20

(58) Field of Search ..... 362/123, 249, 362/252, 806; 428/18–20; D11/118

(56) References Cited

U.S. PATENT DOCUMENTS

| | | | | |
|---|---|---|---|---|
| 2,916,843 | A | | 4/1959 | Meyer |
| 3,603,780 | A | | 9/1971 | Lu |
| 3,797,149 | A | * | 3/1974 | Morrison ..... D11/118 |
| 3,819,459 | A | | 6/1974 | Wren |
| 3,865,676 | A | | 2/1975 | Bogart et al. |
| 4,315,376 | A | | 2/1982 | Eichenauer |
| 5,057,976 | A | | 10/1991 | DuMong |
| D324,832 | S | | 3/1992 | Boschetto et al. |
| D325,134 | S | | 4/1992 | Bustos |
| 5,359,502 | A | | 10/1994 | Cantin |
| D357,432 | S | | 4/1995 | Snodgrass |
| 5,758,948 | A | | 6/1998 | Hale |
| 5,942,294 | A | | 8/1999 | Heim |
| D417,413 | S | | 12/1999 | Pettus |
| 6,139,168 | A | | 10/2000 | Gary et al. |
| 6,334,694 | B1 | | 1/2002 | Huang |
| D462,031 | S | | 8/2002 | Ng |

* cited by examiner

*Primary Examiner*—Stephen F. Husar
(74) *Attorney, Agent, or Firm*—MacCord Mason PLLC

(57) ABSTRACT

An illuminated artificial tree having a display position and a folded position is constructed of an odd number of upright wire mesh panels hingedly attached at their vertical inner edges, the panels including a first end panel, a second end panel and a plurality of intermediate panels between the first and second end panels. A string of decorative lights are attached in a plurality of spaced, reversed loops, the string extending from adjacent the lower edge of the first panel around the intermediate panels to the second panel, then upwardly along the outer edge of the second panel, and then back around the outer edges of the intermediate panels to the first panel, thereby permitting folding of the tree without removal of the light string.

20 Claims, 4 Drawing Sheets

10
22
20
60
24
18
16
30
28
14
58
54
32
26
56
12
51
52

48
40
12
44
46
42

48
50
30

ILLUMINATED ARTIFICIAL TREE

BACKGROUND OF THE INVENTION (1) Field of the Invention

The present invention relates to artificial trees used for holiday decoration, such as Christmas trees that may be folded for storage, and in particular to artificial holiday trees with attached strings of lights that need not be removed when the tree is to be stored.

(2) Description of the Prior Art

Small evergreen trees have historically been decorated with strings of electrical lights and other decorative materials as a part of celebrating Christmas and other-holidays including more recently, Halloween and Easter. As a result of urban living, the cost of natural trees, technological advances, and the desire for convenience, there has been an increasing trend toward the use of artificial trees that can be displayed during the season and stored between seasons.

Generally, such trees are formed of several components, such as a trunk and branches, or tree sections, that are attached for display. The tree, which is normally designed to simulate the appearance of a natural tree, is then decorated in the conventional manner by looping one or more strings of decorative lights around the tree and hanging decorations from the artificial branches. Some trees are designed to avoid the necessity of removing the lights from the tree when the tree is disassembled for storage by running connectable electrical cords within the tree sections and permanently attaching the lights to the branches.

Artificial trees have been developed primarily for indoor use, since the artificial materials and the detachable nature of the tree construction will often not withstand the rigors of an outdoor environment, e.g., low temperature and winds, particularly during the Christmas season. The present inventor has previously produced artificial trees for outdoor use by attaching together a plurality of hexagonal wire mesh panels having the shape of right triangles by hingedly connecting the panels at their inner vertical edges so that the panels may be "fanned out" when the tree is displayed and folded substantially parallel to each other when the tree is to be stored.

These trees have been found to be quite useful for outdoor use since the panels resist deterioration. Also, when the tree is anchored outdoors, the wind passes through the panels without tending to damage the tree. However, these prior art trees have been found to have two disadvantages. First, lights still must be strung onto the trees when the tree is set up for display, with the lights being removed when the tree is to be stored. Second, the trees do not have the appearance of a natural tree that is most desirable, even when the tree is viewed at night.

An artificial tree for use in holiday decoration, particularly an artificial tree suited for outdoor use, that more closely simulated the appearance of a natural tree, and did not require removal of the string of decorative lights prior to storage on the tree would be welcomed by consumers.

SUMMARY OF THE INVENTION

Generally, the artificial tree of the present invention is comprised of a plurality of upright panels with a string of decorative lights attached to the panels in a unique manner so that the tree can be displayed or folded for storage without removal of the lights. The panels each have a vertical inner edge, a horizontal lower edge, and an outer edge extending from the outer end of the lower edge to the top end of the vertical edge. Preferably, the outer edge is straight, resulting in a panel having the shape of a right triangle. However, it is understood that the panel can be tapered inwardly or outwardly to present a different appearance. The of the length of the vertical edge to the length of the horizontal edge is preferably from about 2:1 to 5:1, to give the appearance of a natural tree when the panels are positioned for display of the tree.

The panels are preferably formed of a wire mesh so that air can freely move through the tree without causing the tree to tip over. A preferred form of wire mesh is known as hexagonal wire mesh or hex wire mesh, due to its construction in the form of a plurality of connected wire with hexagonal openings. Mesh of this construction is also known as "chicken wire." However, except for the smallest tree constructions, the wire mesh of the present invention will be of a heavier gauge than conventional chicken wire in order to provide a stiffness and structural integrity to the tree. For example, the wire used to form the mesh may be from about 11# to 25# gauge, it being appreciated that the smaller gauge number designates a thicker wire. Also, for weather resistances well as appearance, the wire mesh is coated with a powder or plastic, e.g., PVC, coating. Galvanized wire may also be used. This wire may be in any desired color, such as green to simulate a natural tree, or other colors such as black, yellow or white for holidays such as Halloween or Easter. The panels are hingedly secured together at their inner vertical edges so that the panels can be opened to the display position or folded for storage. For example, rings can be clamped around the inner edges to join the panels together. The panels include a first panel, a second panel and a plurality of panels located intermediate the first and second panels. When the tree is opened for display, the first and second panels are releasibly joined to each other to hold the tree in the display position. For example, ties may be wrapped around the adjacent outer edges of the first and second panels. The panels are preferably hinged so that the panels are substantially parallel to each other when the tree is in the folded position. The panels may be tied together in the folded positions, if desired.

When the tree is in the displayed position, and the first and second panels are attached to each other, the intermediate panels are spaced equidistantly between the first and second panels. In accordance with the present invention, the tree includes an odd number of panels, e.g., 5,7,9,11 or 13 panels, including the first and second panels and the intermediate panels. When the first and second panels are joined against each other, they appear to be a single panel. Thus, by using an odd number of panels, it is possible to create a tree having a symmetrical appearance, greatly improving the natural appearance of the tree.

The artificial tree of the invention includes a string of decorative lights that are attached in a unique manner to the outer edges of the panels. The light string may be, for example, a conventional string of decorative lights formed of an electrical cord with a plug at one end and a plurality of decorative lights attached along the length of the cord. Different conventional decorative lights may be used, whether larger lights or smaller LED type lights. The length of the string and the number of lights will vary depending on the height and diameter of the tree, i.e., the lengths of the vertical and horizontal edges of the panels. For example, a tree that is four feet in height may have about 500 small LED lights, while a larger six foot tree may have 800 small LED lights. Individual light strings may be connected end-to-end to form a single string, or multiple strings may be used separately and connected to an extension cord.

The lights are strung onto the tree so that the tree can be opened or folded without removal of the lights. This is achieved by first attaching the light string near the lower end of the first panel outer edge, and then extending the string in a first loop from the first panel substantially horizontally around the intermediate panels to the second panel. The string is then attached to the second panel and extended up a part of the outer edge of the second panel to a level above the first loop. The string is then extended in a second or reversed loop substantially horizontally back around the outer edges of the intermediate panels to the first panel.

This procedure is repeated until there are a plurality of spaced loops extending from adjacent the bottom of the tree to adjacent the top of the tree. For instance, if an additional loop is desired, the string, once it is returned to the first panel, then along the outer edge of said first panel, and then back around the outer edges of said intermediate panels to the outer edge of the second panel, thereby forming at least three spaced loops of the light string around the outer periphery of the panels.

When the panels are formed of the preferred wire mesh, spaced wires or points may extend outwardly from the outer edge of each panel. These wires may be wrapped or looped around the light string to hold the light string onto the panel. In addition, by securing the string to the panels, the panels will be positioned equidistantly by the pull of the string when the tree is opened to its display position.

When the holiday season ends, the user simply detaches the first and second panels and folds the panels together in a parallel configuration. Thus, a displayed tree that is, for example, six feet high and five feet in diameter, can be stored in an area of only a few inches in thickness. Importantly, the light string remains attached when the tree panels are folded, thereby eliminating the need to again string the lights onto the tree when the tree is again displayed.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
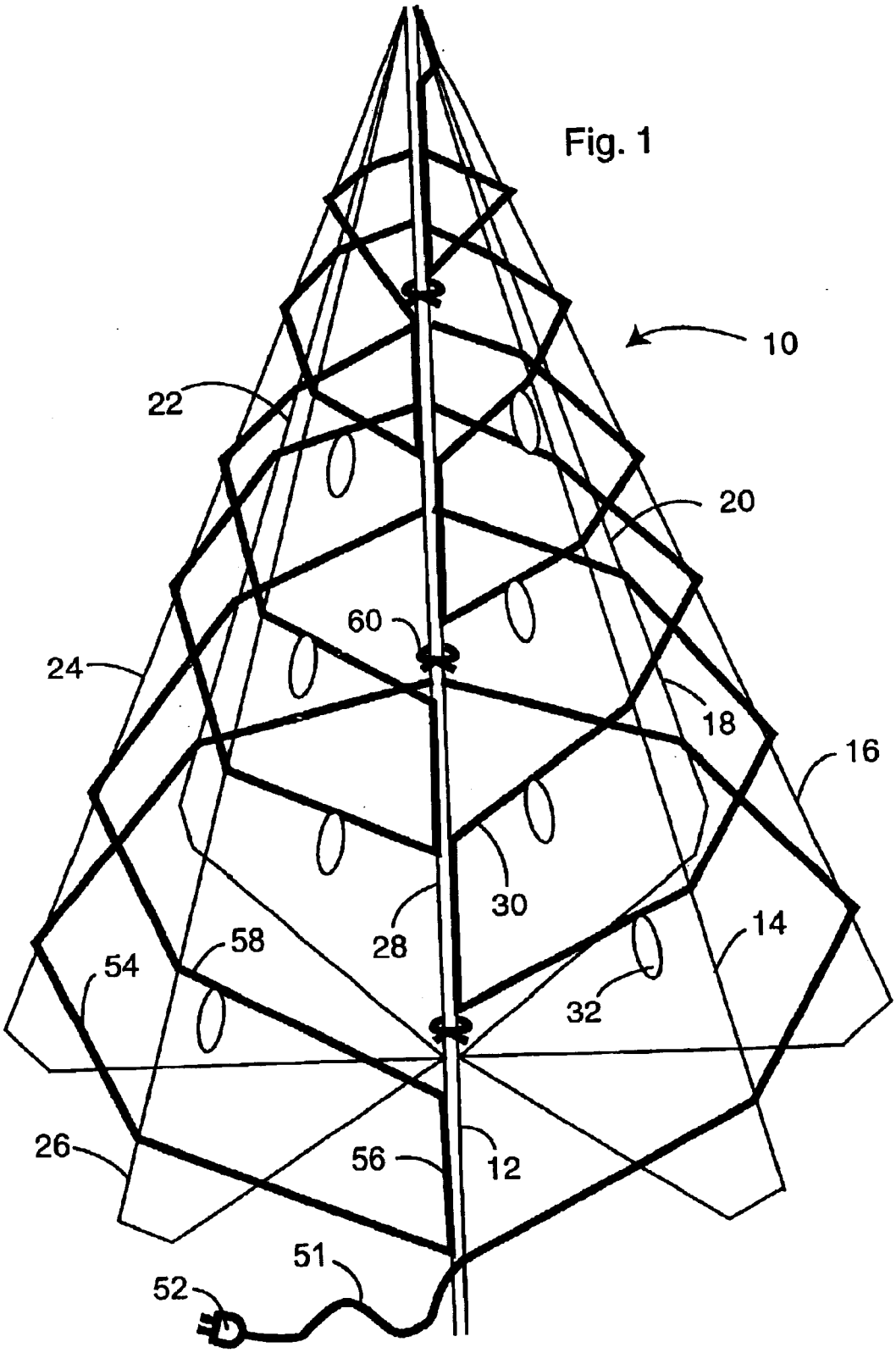
FIG. 1 is a perspective view of an illuminated tree of the present invention, with the panels being shown in outline for better illustration.
Figure 4:
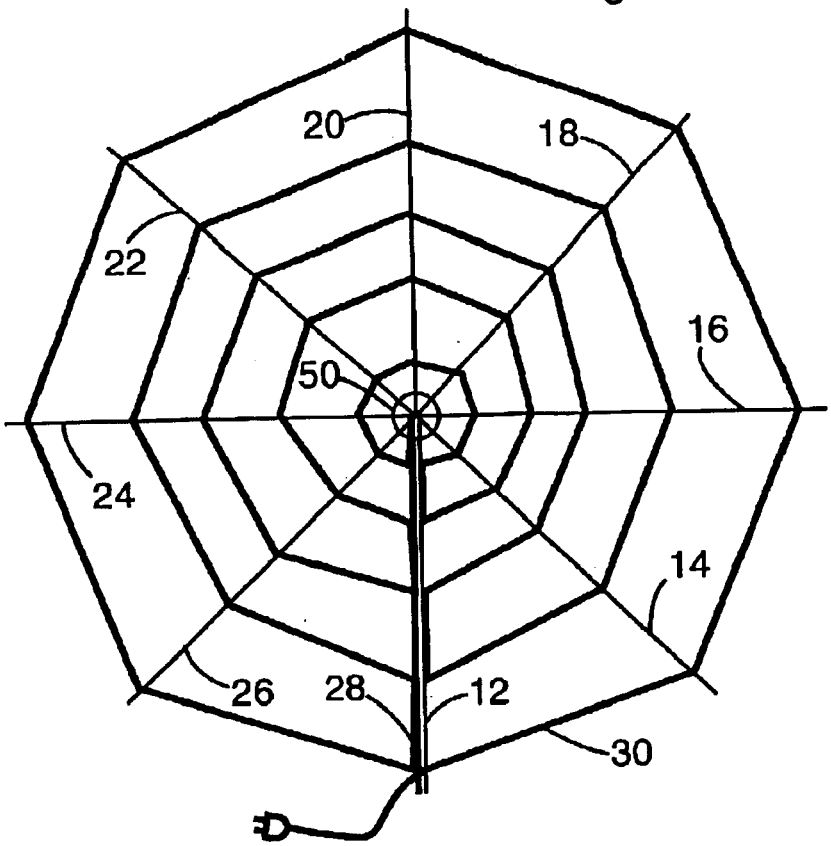
FIG. 4 is a top view of an illuminated tree of the present invention in the display position.
Figure 5:
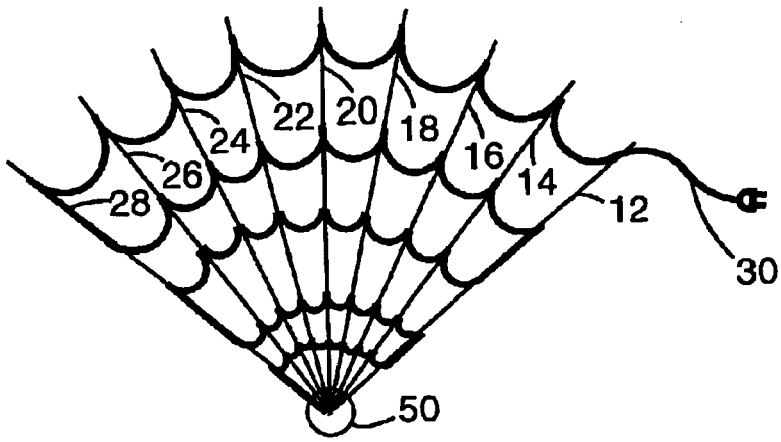
FIG. 5 is a top view of an illuminated tree of the present invention in a partially folded position.
Figure 6:
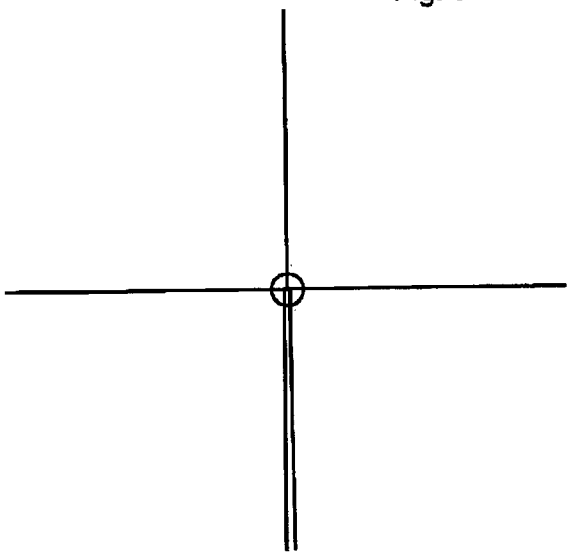
FIG. 6 is a top view of the attached panels of a tree having five panels.
Figure 7:
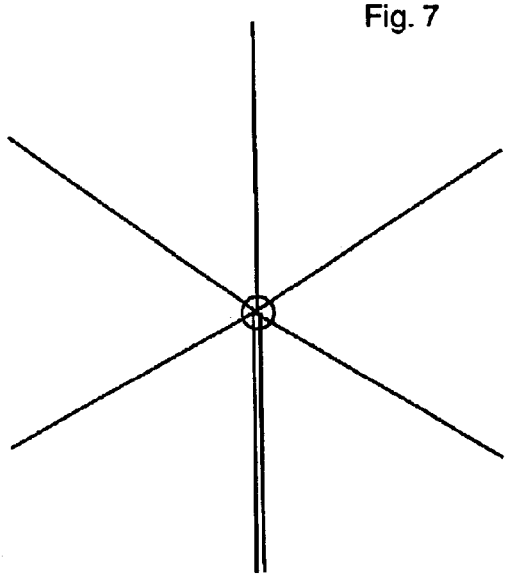
FIG. 7 is a top view of the attached panels of a tree having seven panels.
Figure 8:
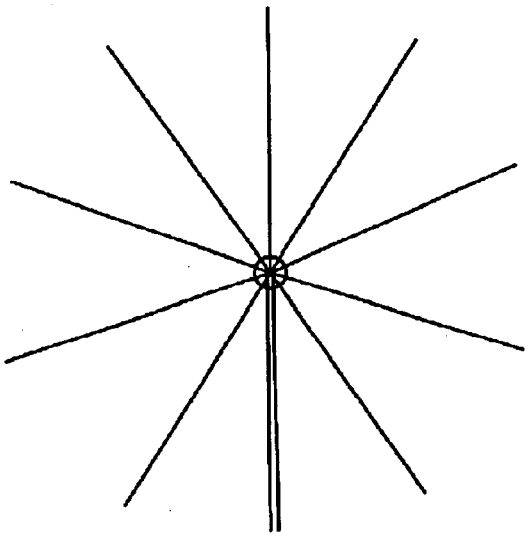
FIG. 8 is a top view of the attached panels of a tree having eleven panels.
Figure 9:
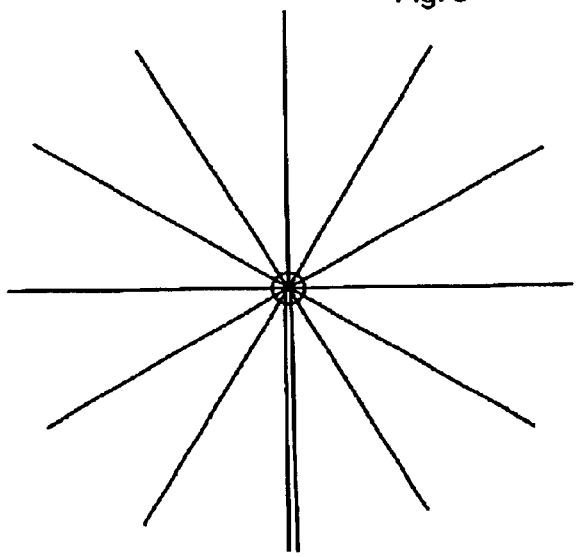
FIG. 9 is a top view of the attached panels of a tree having thirteen panels.

As best illustrated in FIGS. 1, 4 and 5, illuminated artificial tree, generally 10, is comprised of a plurality of panels 12–28 having secured thereto a decorative light string 30. Light string 30 includes a plurality of lights 32, some of which are shown in FIG. 1. Lights 32 have been omitted from FIGS. 4 and 5 to aid in clarity of illustration. While the preferred embodiment is shown with nine panels (panel 20 hidden in FIG. 1), it will be understood that a different number of panels, such as the 7, 11 or 13 panels illustrated in FIGS. 6, 7 and 8, respectively. Generally, larger trees will use a larger number of panels.

Figure 2:
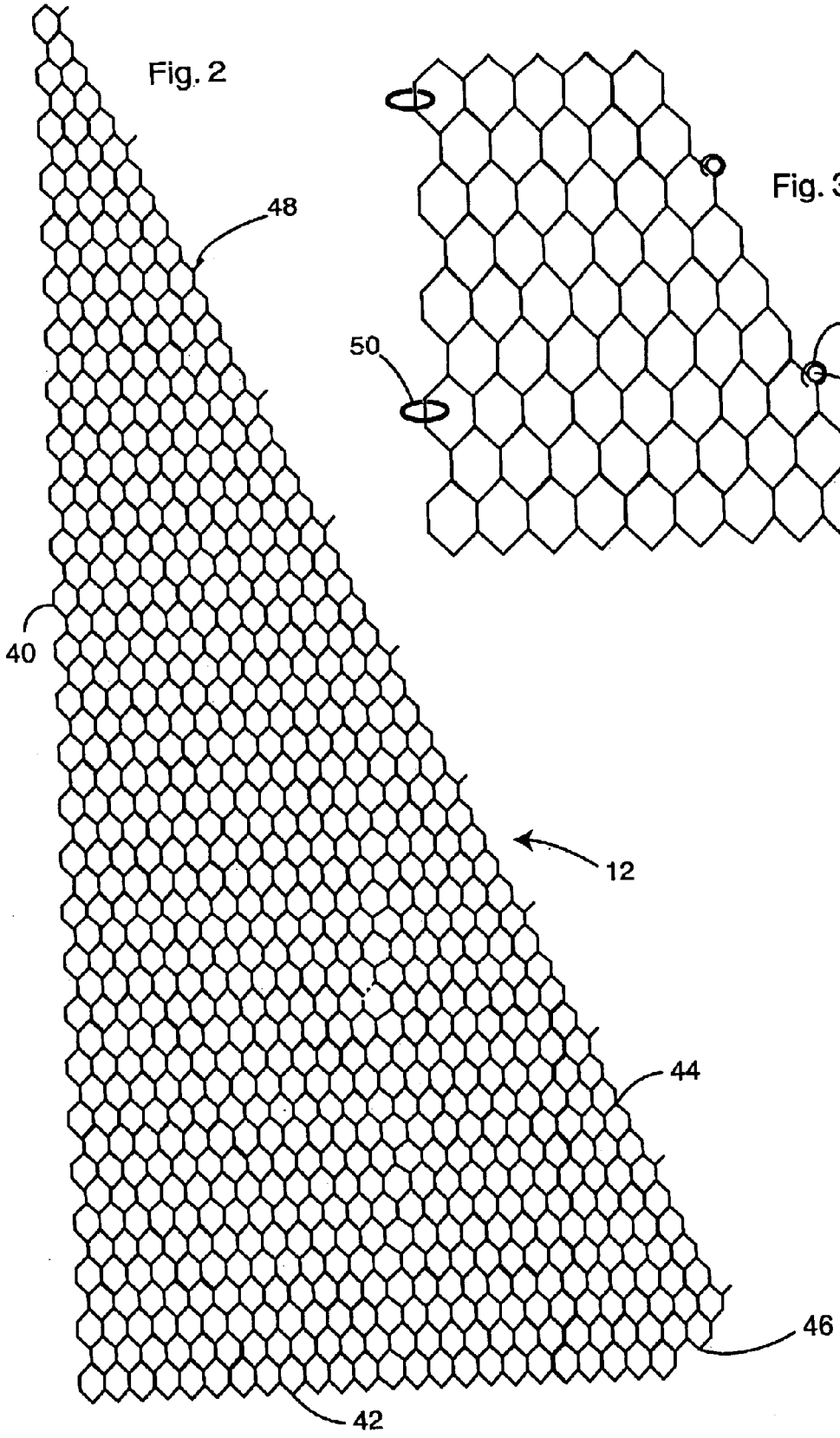
FIG. 2 is side view of a representative panel formed of hexagonal wire mesh.
Figure 3:
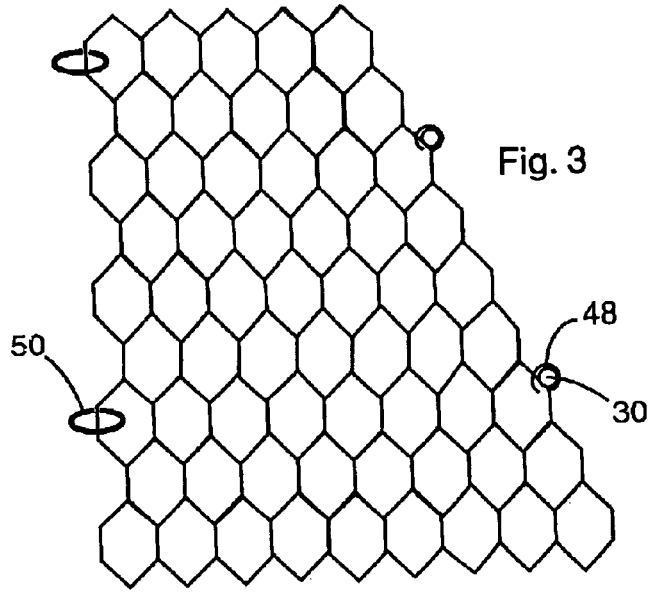
FIG. 3 is a detailed side view of a part of a representative panel.

A typical panel 12 is shown in FIG. 2 and is comprised of coated hexagonal or hex wire mesh. Panel 12, which is in the shape of a right triangle, includes a vertical inner edge 40, a horizontal lower edge 42 and an inclined outer edge 44. The outer end of edge 42 and the lower end of edge 44 meet at a truncated corner 46. Outer edge 44 includes a plurality of equi-spaced light string attachment wires 48. As illustrated in FIG. 3, wires 48 are wrapped or looped around string 30 to secure string 30 to the outer edges of the panels. FIG. 3 also shows rings 50 used to hingedly attach inner vertical edges 40 of the panels.

In describing the positioning of string 30 on the panels, reference will be made to "segments" of string 30. It is to be understood that the reference to segments is intended only to describe parts of the string at various locations. String 30, in the preferred embodiment is formed of a single electrical cord, or a plurality of electrical cords attached by plugs at their ends in conventional manner, and are not formed of separate detachable segments. However, multiple strings that are separately attached to a common electrical source can also be used.

In order to avoid detachment of string 30 from outer edges 48 of the panels when tree 10 is to be stored, string 30 is first attached adjacent the lower edge of a first panel 12. A first segment 51 terminating in plug 52 is left extending from panel 12 to facilitate plugging of string 30 into an electrical outlet or to an extension cord. String 30 is then attached to the outer edges of the intermediate panels 14–26 along a substantially horizontal pathway or loop 54 around tree 10 using wires 48 to secure string 30 to the panels.

String 30 is then attached to the outer edge of second panel 28, and a segment 56 is extended upwardly along the outer edge of panel 28 to a level about loop 54. String 30 is then extended in a substantially horizontal reverse loop 58 back around, and secured to, intermediate panels 14–26, returning to first panel 12. String 12 is then extended upwardly along the outer edge of panel 12 to a level above reverse loop 58. This procedure is repeated until the top of tree 10 is reached, resulting in a plurality of spaced horizontal reversed loops surrounding tree 10, except for the space between panels 12 and 28.

When in the opened or display position, as shown in FIGS. 1 and 4, first and second panels 12 and 28 are secured to each other with ties 60. When tree 10 is to be stored, panels 12 and 28 are detached and all panels are folded together in an abutting parallel relationship. FIG. 5 shows these panels in a partially folded position. It will be seen from these illustrations that the light string is secured around the tree panels when the tree is in the display position, and remains attached to the panels when the tree is folded, thereby eliminating the need to detach the light string prior to storage.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An artificial tree having a display position and a folded position, said tree being comprised of:

a) a plurality of panels, each panel having a lower edge, a vertical inner edge, and an outer edge, said panels being hingedly attached at their vertical edges, said panels including a first end panel, a second end panel and a plurality of intermediate panels between said first and second end panels, said first and second panels being releasibly attached to each other when said tree is in the display position; and b) a string of decorative lights attached to the outer edges of said panels, said string extending from said first panel around said intermediate panels to said second panel, and then back around the outer edges of said intermediate panels to said first panel, thereby forming at least two spaced loops of said string around said panels.

2. The artificial tree of claim 1, wherein said panels are in the shape of right triangles.

3. The artificial tree of claim 1, wherein said panels are formed of wire mesh.

4. The artificial tree of claim 1, having an odd number of panels.

5. The artificial tree of claim 1, wherein said panel lower edge is horizontal and the ratio of the length of said vertical edge to the length of said horizontal edge is from about 2:1 to about 5:1.

6. The artificial tree of claim 1, wherein said lower edge and said outer edge join at a truncated corner.

7. The artificial tree of claim 1, wherein said panel outer edge includes spaced wires having fee ends, said light string being joined to said outer edges by looping said wires around said light string.

8. An artificial tree having a display position and a folded position, said tree being comprised of:

a) an odd number of panels, each panel having a lower edge, a vertical inner edge, and an outer edge, said panels being hingedly attached at their vertical edges, said panels including a first end panel, a second end panel and a plurality of intermediate panels between said first and second end panels, said first and second panels being releasibly attached to each other when said tree is in the display position; and b) a string of decorative lights attached to the outer edges of said panels, said string extending from said first panel around said intermediate panels to said second panel, then along the outer edge of said second panel, then back around the outer edges of said intermediate panels to said first panel, then along the outer edge of said first panel, and then back around the outer edges of said intermediate panels to the outer edge of said second panel, thereby forming at least three spaced loops of said string around said panels.

9. The artificial tree of claim 8, wherein the odd number of panels is from 5 to 13 panels.

10. The artificial tree of claim 8, wherein said panels are formed of a coated wire mesh.

11. The artificial tree of claim 8, wherein said tree has a bottom and a top, said light string extending in a plurality of spaced reversed loops around said tree from adjacent the bottom of said tree to adjacent the top of said tree.

12. The artificial tree of claim 8 wherein said panels are in the shape of right triangles.

13. The artificial tree of claim 8, wherein said panel lower edge is horizontal and the ratio of the length of said vertical edge to the length of said horizontal edge is from about 2:1 to about 5:1.

14. The artificial tree of claim 8, wherein said panel outer edge includes spaced wires having free ends, said light string being joined to said outer edges by looping said wires around said light string.

15. An artificial tree having a display position and a folded position, said tree being comprised of:

a) an odd number of wire mesh panels in the shape of right triangles, each panel having a lower edge, a vertical inner edge, and an inclined outer edge, said panels being hingedly attached at their vertical edges, said panels including a first end panel, a second end panel and a plurality of intermediate panels between said first and second end panels, said first and second panels being releasibly attached to each other when said tree is in the display position; and b) a string of decorative lights attached in a plurality of spaced, reversed loops to the outer edges of said panels, said string extending firm adjacent the lower edge of said first panel around said intermediate panels to said second panel, then upwardly along the outer edge of said second panel, then back around the outer edges of said intermediate panels to said first panel, then upwardly along the outer edge of said first panel, and then back around the outer edges or said intermediate panels to the outer edge of said second panel.

16. The artificial tree of claim 15, wherein said wire mesh is a coated hexagonal wire mesh.

17. The artificial tree of claim 15, wherein said panel outer edge includes spaced wires having free ends, said light string being joined to said outer edges by looping said wires around said light string.

18. The artificial tree of claim 15, wherein said panels are substantially parallel to each other when said tree is in the folded position.

19. The artificial tree of claim 15, wherein said panel lower edge is horizontal and the ratio of the length of said vertical edge to the length of said horizontal edge is from about 2:1 to about 5:1.

20. The artificial tree of claim 15, wherein the odd number of panels is from 5 to 13 panels.

* * * * *